US010878747B1

(12) United States Patent
Gao et al.

(10) Patent No.: US 10,878,747 B1
(45) Date of Patent: Dec. 29, 2020

(54) OPTICAL UNIFORMITY COMPENSATION

(71) Applicant: Apple Inc., Cupertino, CA (US)

(72) Inventors: Shengkui Gao, San Jose, CA (US); Chaohao Wang, Sunnyvale, CA (US); Hung Sheng Lin, San Jose, CA (US); Hyunsoo Kim, Mountain View, CA (US); Hyunwoo Nho, Palo Alto, CA (US); Injae Hwang, Cupertino, CA (US); Jesse Aaron Richmond, San Francisco, CA (US); Jie Won Ryu, Santa Clara, CA (US); Junhua Tan, Saratoga, CA (US); Kingsuk Brahma, Mountain View, CA (US); Myung-Je Cho, San Jose, CA (US); Myungjoon Choi, Sunnyvale, CA (US); Shiping Shen, Cupertino, CA (US); Sun-Il Chang, San Jose, CA (US); Wei H. Yao, Palo Alto, CA (US); Yi Qiao, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/506,986

(22) Filed: Jul. 9, 2019

Related U.S. Application Data

(60) Provisional application No. 62/696,970, filed on Jul. 12, 2018.

(51) Int. Cl.
*G09G 3/3216* (2016.01)
*G09G 5/00* (2006.01)
*G09G 5/39* (2006.01)

(52) U.S. Cl.
CPC ..... *G09G 3/3216* (2013.01); *G09G 5/003* (2013.01); *G09G 5/39* (2013.01); *G09G 2320/041* (2013.01); *G09G 2320/043* (2013.01); *G09G 2340/0407* (2013.01)

(58) Field of Classification Search
None
See application file for complete search history.

(56) References Cited

U.S. PATENT DOCUMENTS

2010/0265228 A1* 10/2010 Kimura ..... G09G 3/3233 345/207
2015/0097858 A1* 4/2015 Miki ..... G06T 3/005 345/629
2016/0254321 A1* 9/2016 Zhang ..... H01L 21/77 257/40
2017/0116901 A1* 4/2017 Ogoshi ..... G09G 3/20

* cited by examiner

*Primary Examiner* — Aneeta Yodichkas
(74) *Attorney, Agent, or Firm* — Fletcher Yoder P.C.

(57) ABSTRACT

Methods and systems for compensating a display of an electronic device using internal sensing and external compensation. The external compensation uses a generated compensation map that then is used to compensate for variations that occur outside of display circuitry. The internal sensing compensation is used to compensate for internally sensed parameters (e.g., aging) of the display.

20 Claims, 10 Drawing Sheets

OPTICAL UNIFORMITY COMPENSATION

CROSS-REFERENCE TO RELATED APPLICATIONS

This application claims the benefit of U.S. Provisional Application No. 62/696,970, entitled "Optical Uniformity Compensation," filed on Jul. 12, 2018, which is incorporated herein by reference in its entirety for all purposes.

BACKGROUND

The present disclosure relates generally to techniques to sensing non-uniformity in a display. More specifically, the present disclosure relates generally to techniques for sensing and compensating for non-uniformity in a display.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Electronic display panels are used in a plethora of electronic devices. These display panels typically include multiple pixels that emit light. The pixels may be formed using self-emissive units (e.g., light emitting diode) or pixels that utilize units that are backlit (e.g., liquid crystal display). The displays may be compensated for non-uniformity. However, sensing circuitry in the electronic device sensing for non-uniformity may detect some sources of non-uniformity and not detect other sources of non-uniformity.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

Display panel uniformity may be negatively impacted by various parameters (e.g., aging, curvature, aperture defects) of the display panel. The display panel uniformity may be improved by externally sensing non-uniformity properties in a display from outside the display panel (and its electronic device) during and/or after manufacture before use. The external sensing may detect and be used to compensate for static causes (e.g., screen curvature, aperture defects, etc.). The results of the initial external sensing may be stored in the device. However, the external sensing may be performed less frequently (e.g., only once) than is suitable to track dynamic causes (e.g., aging of the display). Instead, internal sensing may be used to track such changes more frequently than the external sensing. The internal and external sensing operations may be combined together to compensate the externally sensed constant causes and the internally sensed dynamic causes.

BRIEF DESCRIPTION OF THE DRAWINGS

Various aspects of this disclosure may be better understood upon reading the following detailed description and upon reference to the drawings in which.

DETAILED DESCRIPTION OF SPECIFIC EMBODIMENTS

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Display panel uniformity can be improved by externally sensing non-uniformity properties or characteristics in a display at or around a time of manufacture of the electronic device. The external sensing may detect and be used to compensate for static causes (e.g., screen curvature, aperture defects, etc.) of the non-uniform display properties. The results of the initial external sensing may be stored in the device. However, the external sensing may be performed less frequently (e.g., only once) than is suitable to track dynamic causes (e.g., aging of the display). Instead, an internal sensing circuit may be used to track such changes more frequently than the external sensing. The internal and external sensing operations may be combined together to compensate the externally sensed constant causes and the internally sensed dynamic causes by passing the results of the external sensing to the internal sensing circuit that causing cumulative compensation for non-uniformity properties (e.g., luminance, color) detected using the external and internal sensing results.

Figure 1:
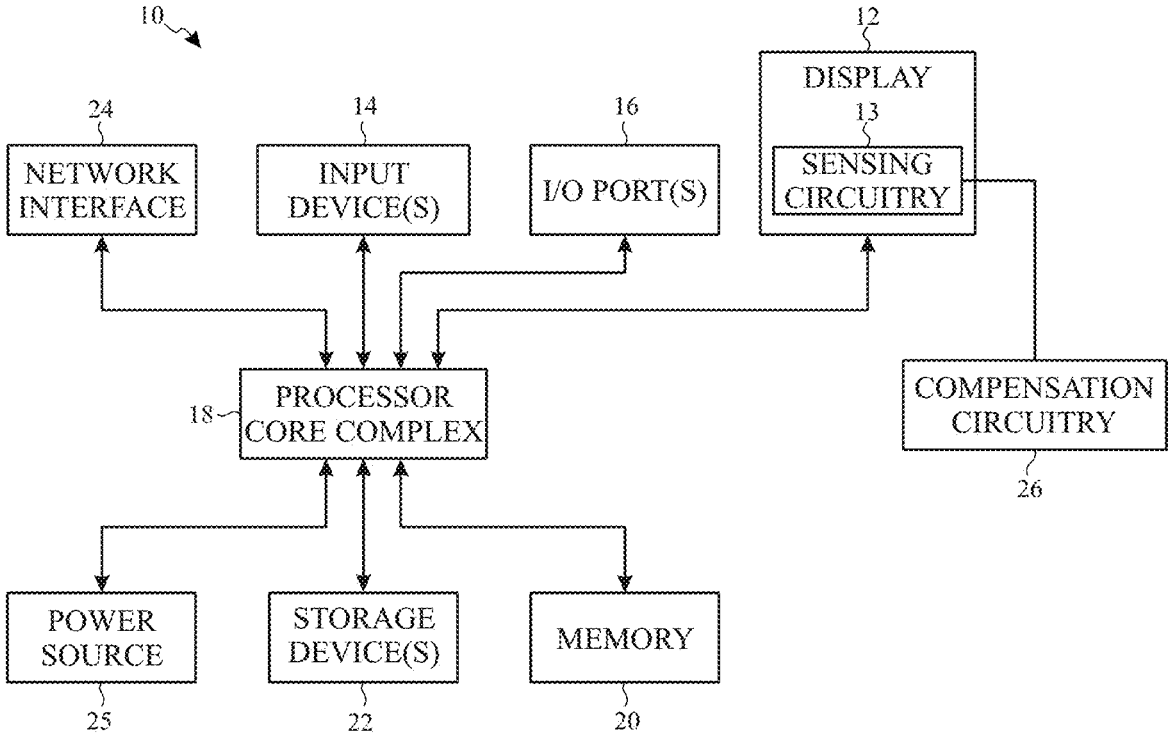
FIG. 1 is a block diagram of an electronic device including a display with sensing and compensation circuitry, in accordance with an embodiment.

A general description of suitable electronic devices that may include a self-emissive display, such as an LED (e.g., an OLED) display, and corresponding circuitry of this disclosure are provided. To help illustrate, an electronic device 10 including an electronic display 12 is shown in FIG. 1. As will be described in more detail below, the electronic device 10 may be any suitable electronic device, such as a computer, a mobile phone, a portable media device, a tablet, a television, a virtual-reality headset, a vehicle dashboard, and the like. Thus, it should be noted that FIG. 1 is merely an example of a particular implementation and is intended to illustrate the types of components that may be present in the electronic device 10.

In the depicted embodiment, the electronic device 10 includes the electronic display 12, one or more input device(s) 14, one or more input/output (I/O) ports 16, a processor core complex 18 having one or more processor(s) or processor cores, local memory 20, main memory storage device(s) 22, a network interface 24, a power source 25, and compensation circuitry 26. The various components described in FIG. 1 may include hardware elements (e.g., circuitry), software elements (e.g., a tangible, non-transitory computer-readable medium storing instructions), or a combination of both hardware and software elements. It should be noted that, in some embodiments, the various depicted components may be combined into fewer components or separated into additional components. For example, the local memory 20 and the main memory storage device 22 may be included in a single component. Additionally, the image processing circuitry 26 (e.g., a graphics processing unit (GPU)) may be at least partially included in the processor core complex 18 and/or the display.

Using pixels containing LEDs (e.g., OLEDs), the display 12 may show images. The display 12 may include touch-screen functionality for users to interact with a user interface appearing on the display 12. The display 12 may include sensing circuitry 13 that is used to sense non-uniformity of the display 12 by sensing changes in one or more parameters (e.g., voltage/current) through thin-film transistors (TFTs) and/or emissive elements in the display 12.

The sensing circuitry 13 may utilize inputs from the compensation circuitry 24 that stores and compensates for externally sensed non-uniformity. In some embodiments, functions of the compensation circuitry 26 may be embodied in the processor core complex 12. Similarly, in certain embodiments, the compensation circuitry 26 may store the compensation values in the storage device(s) 22 and/or locally within the compensation circuitry 26. The inputs from the compensation circuitry 26 to the sensing circuitry 13 may include compensated image data that compensates image data for externally sensed non-uniformity. Additionally or alternatively, the inputs from the compensation circuitry 26 to the sensing circuitry 13 may include a reference current that is utilized by the sensing circuitry 13 to internally sense non-uniformity in the display 12 (e.g., aging of TFTs and/or emissive elements).

As depicted, the processor core complex 18 is operably coupled to the local memory 20 and the main memory storage device(s) 22. Thus, the processor core complex 18 may execute instruction stored in local memory 20 and/or the main memory storage device 22 to perform operations, such as generating and/or transmitting image data. As such, the processor core complex 18 may include one or more general purpose microprocessors, one or more application specific processors (ASICs), one or more field programmable logic arrays (FPGAs), or any combination thereof. Furthermore, as previously noted, the processor core complex 18 may include one or more separate processing logical cores that each process data according to executable instructions.

In addition to the executable instructions, the local memory 20 and/or the main memory storage device 22 may store the data to be processed by the cores of the processor core complex 18. Thus, in some embodiments, the local memory 20 and/or the main memory storage device 22 may include one or more tangible, non-transitory, computer-readable media. For example, the local memory 20 may include random access memory (RAM) and the main memory storage device 22 may include read only memory (ROM), rewritable non-volatile memory such as flash memory, hard drives, optical discs, and the like.

As depicted, the processor core complex 18 is also operably coupled to the network interface 24. In some embodiments, the network interface 24 may facilitate communicating data with other electronic devices via network connections. For example, the network interface 24 (e.g., a radio frequency system) may enable the electronic device 10 to communicatively couple to a personal area network (PAN), such as a Bluetooth network, a local area network (LAN), such as an 802.11x Wi-Fi network, and/or a wide area network (WAN), such as a 4G or LTE cellular network.

Additionally, as depicted, the processor core complex 18 is operably coupled to the power source 25. In some embodiments, the power source 25 may provide electrical power to one or more component in the electronic device 10, such as the processor core complex 18 and/or the electronic display 12. Thus, the power source 25 may include any suitable source of energy, such as a rechargeable lithium polymer (Li-poly) battery and/or an alternating current (AC) power converter.

Furthermore, as depicted, the processor core complex 18 is operably coupled to the I/O ports 16. In some embodiments, the I/O ports 16 may enable the electronic device 10 to receive input data and/or output data using port connections. For example, a portable storage device may be connected to an I/O port 16 (e.g., universal serial bus (USB)), thereby enabling the processor core complex 18 to communicate data with the portable storage device.

As depicted, the electronic device 10 is also operably coupled to input devices 14. In some embodiments, the input device 14 may facilitate user interaction with the electronic device 10 by receiving user inputs. For example, the input devices 14 may include one or more buttons, keyboards, mice, trackpads, microphones, and/or the like. Additionally, in some embodiments, the input devices 14 may include touch-sensing components in the electronic display 12. In such embodiments, the touch sensing components may receive user inputs by detecting occurrence and/or position of an object touching the surface of the electronic display 12.

In addition to enabling user inputs, the electronic display 12 may include a display panel with one or more display pixels. As described above, the electronic display 12 may control light emission from the display pixels to present visual representations of information, such as a graphical user interface (GUI) of an operating system, an application interface, a still image, or video content, by display image frames based at least in part on corresponding image data. In some embodiments, the electronic display 12 may be a display using liquid crystal display (LCD), a self-emissive display, such as an organic light-emitting diode (OLED) display, or the like. Moreover, in some embodiments, the electronic display 12 may refresh display of an image and/or an image frame, for example, at 60 Hz (corresponding to refreshing 60 frames per second), 120 Hz (corresponding to refreshing 120 frames per second), and/or 240 Hz (corresponding to refreshing 240 frames per second).

As depicted, the electronic display 12 is operably coupled to the processor core complex 18 and the image processing circuitry 26. In this manner, the electronic display 12 may display image frames based at least in part on image data generated by the processor core complex 18 and/or the image processing circuitry 26. Additionally or alternatively, the electronic display 12 may display image frames based at least in part on image data received via the network interface 24 and/or the I/O ports 16.

Figure 2:
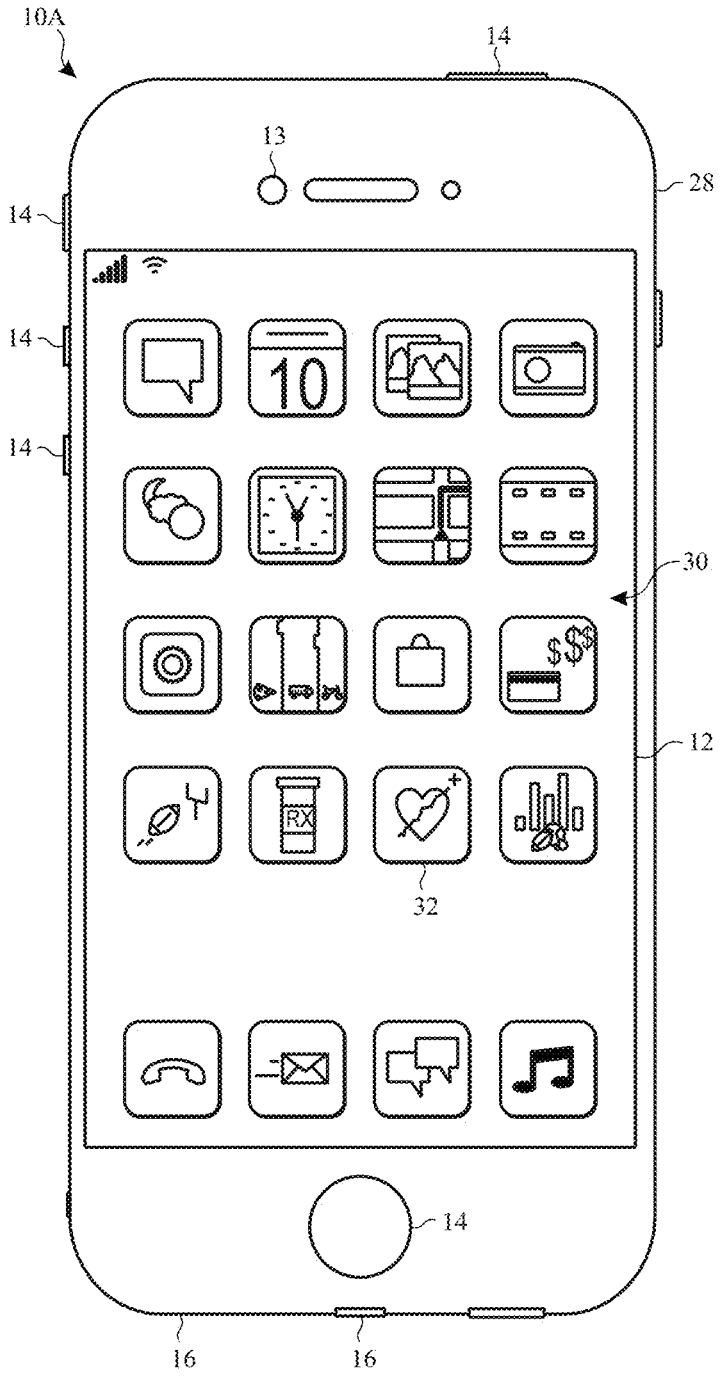
FIG. 2 is one example of the electronic device of FIG. 1, in accordance with an embodiment of the present disclosure.

As described above, the electronic device 10 may be any suitable electronic device. To help illustrate, one example of a suitable electronic device 10, specifically a handheld device 10A, is shown in FIG. 2. In some embodiments, the handheld device 10A may be a portable phone, a media player, a personal data organizer, a handheld game platform, and/or the like. For example, the handheld device 10A may be a smart phone, such as any IPHONE® model available from Apple Inc.

As depicted, the handheld device 10A includes an enclosure 28 (e.g., housing). In some embodiments, the enclosure 28 may protect interior components from physical damage and/or shield them from electromagnetic interference. Additionally, as depicted, the enclosure 28 surrounds the electronic display 12. In the depicted embodiment, the electronic display 12 is displaying a graphical user interface (GUI) 30 having an array of icons 32. By way of example, when an icon 32 is selected either by an input device 14 or a touch-sensing component of the electronic display 12, an application program may launch.

Furthermore, as depicted, input devices 14 may extend through the enclosure 28. As described above, the input devices 14 may enable a user to interact with the handheld device 10A. For example, the input devices 14 may enable the user to activate or deactivate the handheld device 10A, navigate a user interface to a home screen, navigate a user interface to a user-configurable application screen, activate a voice-recognition feature, provide volume control, and/or toggle between vibrate and ring modes. As depicted, the I/O ports 16 also open through the enclosure 28. In some embodiments, the I/O ports 16 may include an audio jack to connect to external devices. In some embodiments, the I/O ports 16 may include a speaker that outputs sounds from the handheld device 10A and/or a microphone that captures sounds at the handheld device 10A.

Figure 3:
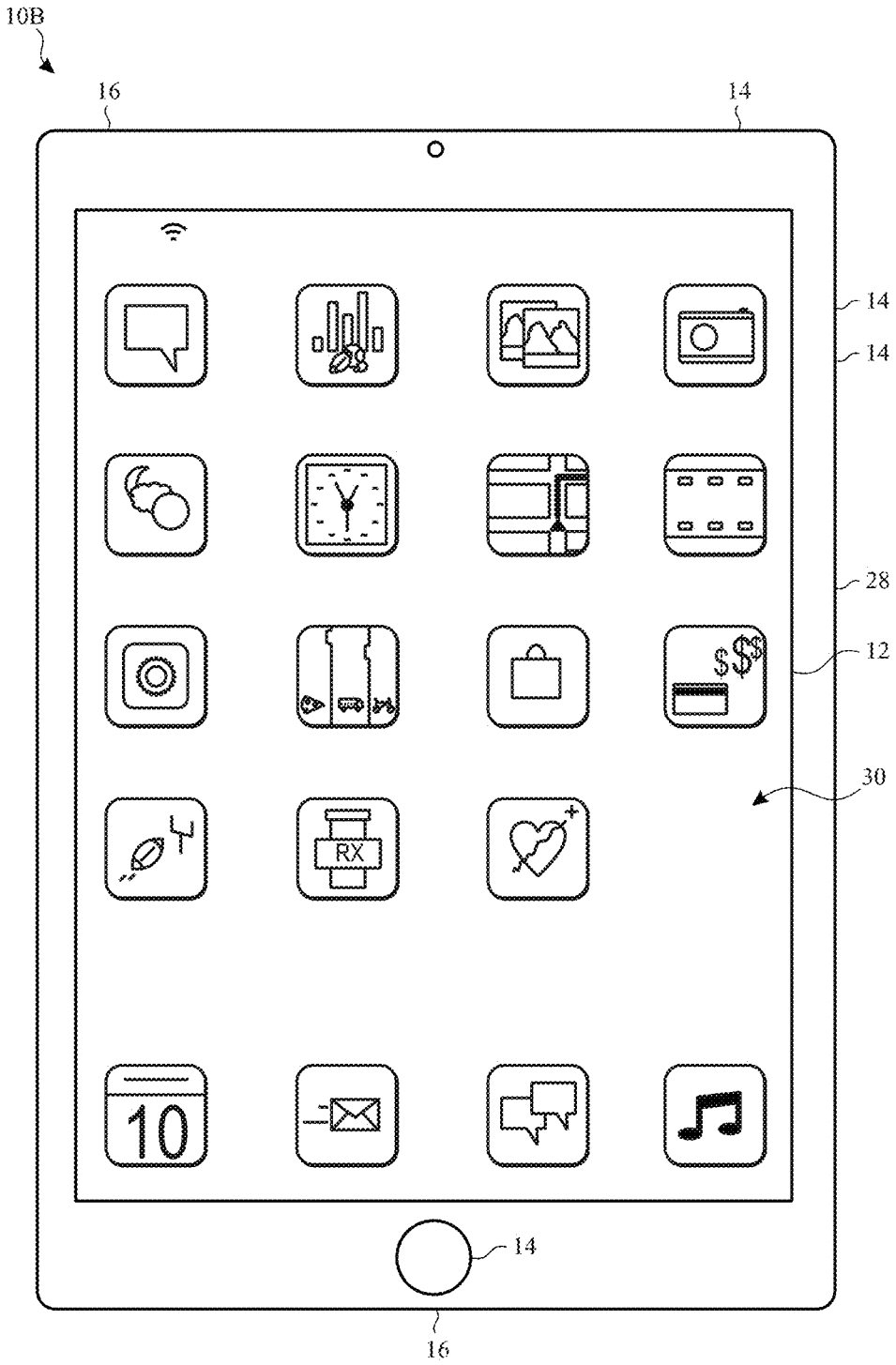
FIG. 3 is another example of the electronic device of FIG. 1, in accordance with an embodiment of the present disclosure.
Figure 4:
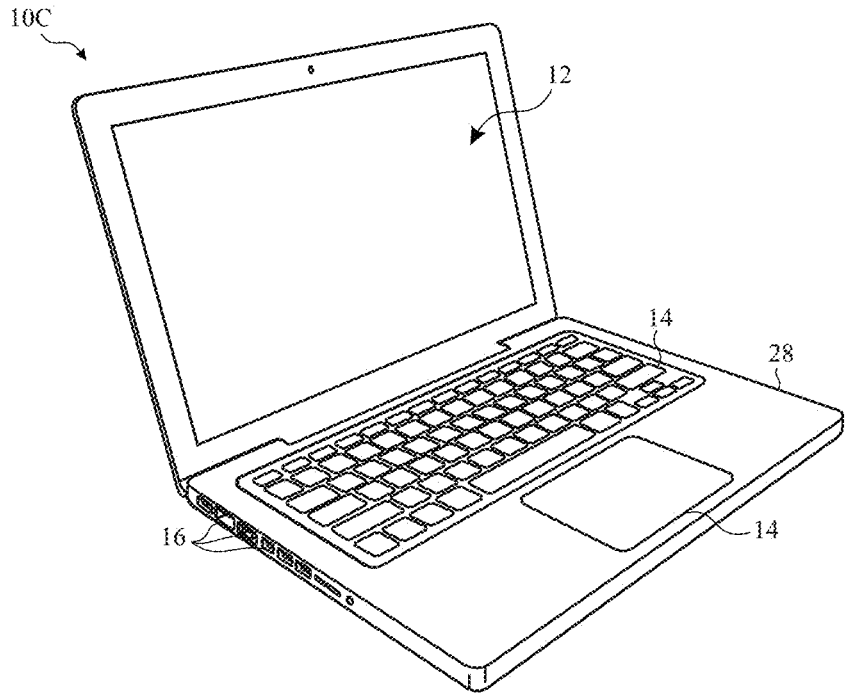
FIG. 4 is another example of the electronic device of FIG. 1, in accordance with an embodiment of the present disclosure.
Figure 5:
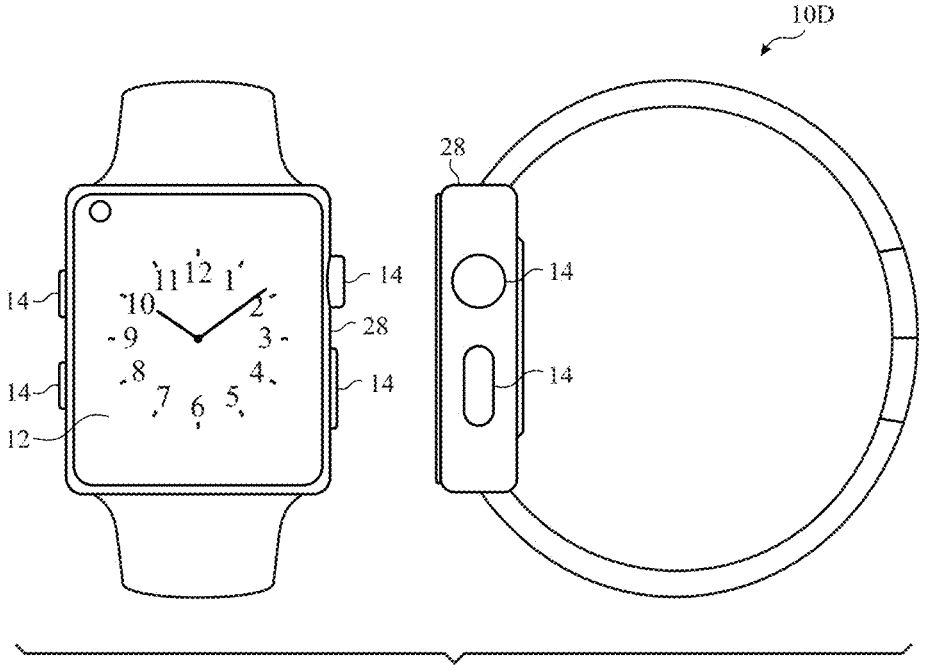
FIG. 5 is another example of the electronic device of FIG. 1, in accordance with an embodiment of the present disclosure.

To further illustrate an example of a suitable electronic device 10, specifically a tablet device 10B, is shown in FIG. 3. For illustrative purposes, the tablet device 10B may be any IPAD® model available from Apple Inc. A further example of a suitable electronic device 10, specifically a computer 10C, is shown in FIG. 4. For illustrative purposes, the computer 10C may be any MACBOOK® or IMAC® model available from Apple Inc. Another example of a suitable electronic device 10, specifically a wearable device 10D, is shown in FIG. 5. For illustrative purposes, the wearable device 10D may be any APPLE WATCH® model available from Apple Inc. As depicted, the tablet device 10B, the computer 10C, and the wearable device 10D each also includes an electronic display 12, input devices 14, and an enclosure 28.

Although the following discusses sensing current through an OLED as a pixel, some embodiments may include measuring other parameters suitable for other pixel types. For example, voltage may be sensed at LED/LCD pixels in the display.

Figure 6:
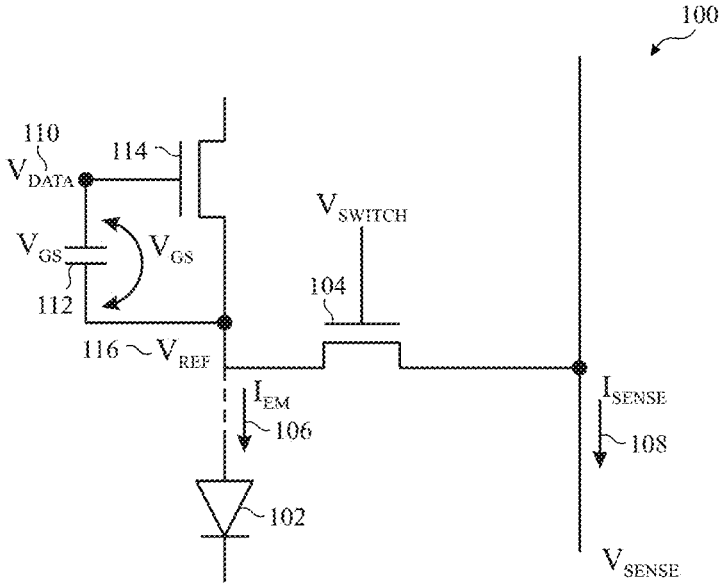
FIG. 6 illustrates a schematic diagram view of a unit pixel of the display of FIG. 1, in accordance with an embodiment.

FIG. 6 illustrates a schematic diagram of a pixel 100 that includes an emissive element 102. The pixel 100 also includes a transistor 104 (e.g., TFT) that controls whether the pixel 100 is in an emissive or sensing state. In the emissive state, the transistor 104 directs an emissive current 106 through the emissive element 102 to emit light from the emissive element. In the sensing state, the transistor 104 directs voltages to create a sensing current 108.

An amount of the current determines luminance of the emissive element 102 is based at least in part on a data voltage 110. The data voltage 110 creates a voltage differential across a capacitor 112 that is equivalent to a gate-to-source voltage (VGs) of a transistor 114 that also sets a level of a reference voltage 116. Differences in the transistor 104 and/or transistors 114 may impact driving conditions of the emissive element 102 potentially causing non-uniformity of different pixels in the display 12. Furthermore, emission elements 102 of different pixels may have different emission efficiencies that may also cause different luminance levels of different pixels using a same driving current.

Figure 7:
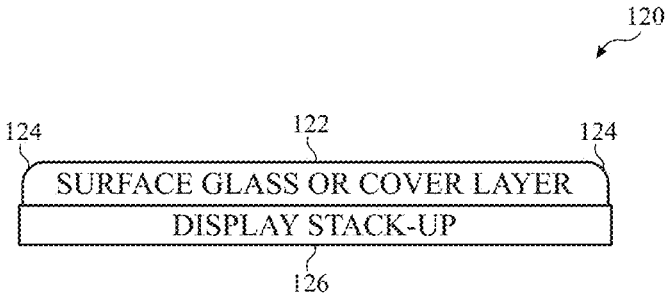
FIG. 7 illustrates a block diagram of the display of FIG. 1, in accordance with an embodiment.
Figure 8:
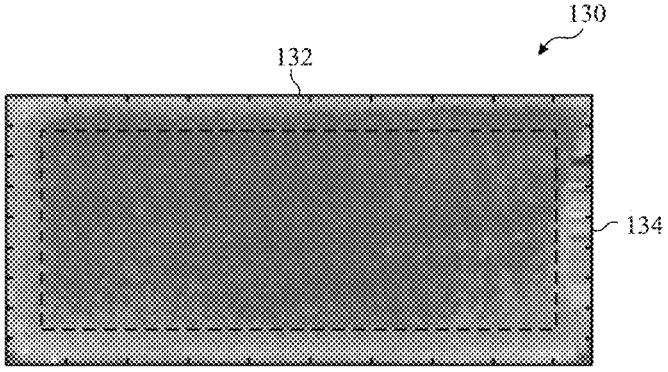
FIG. 8 illustrates an example emission map for the display of FIG. 1, in accordance with an embodiment.

The display 12 may also be subject to other causes of non-uniformity. For example, as illustrated in FIG. 7, the display 12 may include a surface layer 120. The surface layer 120 may include an enclosure of the display 12 that has a substantially flat portion 122 that and curved portions 124. The surface layer 120 is located atop a display stack-up 126 (e.g., array of pixels 100). Light emitted from emissive elements 102 under the curved portions 124 may exit the surface layer 120 differently than light emitted from emissive elements 102 under the substantially flat portion 122. For example, FIG. 8 shows an emission map 130 that may result from having a surface layer 120 that has the substantially flat portion 122 and the curved portions 124. As illustrated, light emitted in a flat zone 132 corresponding to the substantially flat portion 122 is substantially homogenous within the flat zone 132 but may be non-uniform with respect to light emitted (e.g., luminance, brightness) in a curved zone 134 at edges of the display 12. The non-uniformity properties may include a percentage change of output luminance of light in the curved zone 134 relative to the flat zone 132, a constant change of output luminance of light in the curved zone 134 relative to the flat zone 132, and/or may include color changes of light emitted in the curved zone 134 relative to the flat zone 132. Since these changes occur independent of what is occurring in the display stack-up 126 (i.e., has no effect on the sensing current 108), internal sensing using the sensing circuitry 13 may not be able to detect the non-uniformity attributable to the surface layer 120.

Figure 9:
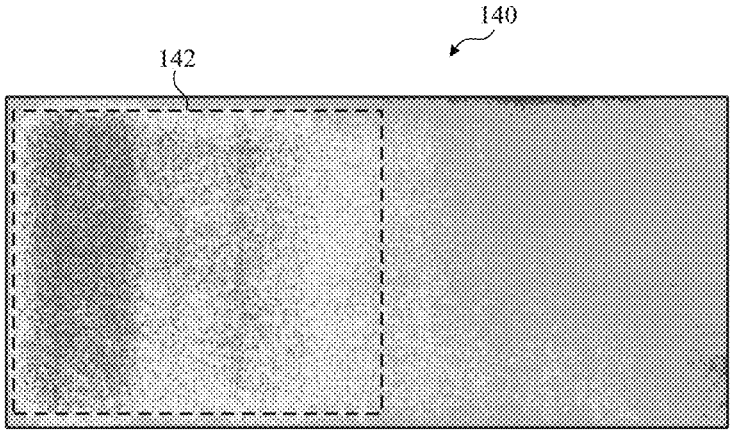
FIG. 9 illustrates an example emission map of the display of FIG. 1 due to misalignment of a fine metal mask during manufacture of the display, in accordance with an embodiment.

The display 12 may also be subject to device aperture non-uniformity. For example, the display 12 may utilize one or more production components (e.g., a fine metal mask (FMM)) that may enable production and/or use of the display stack-up 126. However, the production components and/or their applications may lead to variations (e.g., due to misalignment of the FMM) from a design of the display stack-up 126. For example, a variation of a shape/size of an aperture of the FMM used to produce the display stack-up 126 may lead to more or less light being emitted from a respective portion of the display stack-up 126 corresponding to the aperture. This variation, when uncompensated for, may result in color drift and/or brightness variations in emitted light from the respective portion of the display 12. For example, FIG. 9 illustrates an emission map 140 that may result from a misaligned FMM for at least one color (e.g., red) of the display stack-up 126. As illustrated, the emission map 140 shows a portion 142 that includes a color/brightness variation. Furthermore, since these variations may be independent of the sensing current 108, internal sensing using the sensing circuitry 13 may not be able to detect the non-uniformity attributable to the surface layer 120.

Figure 10:
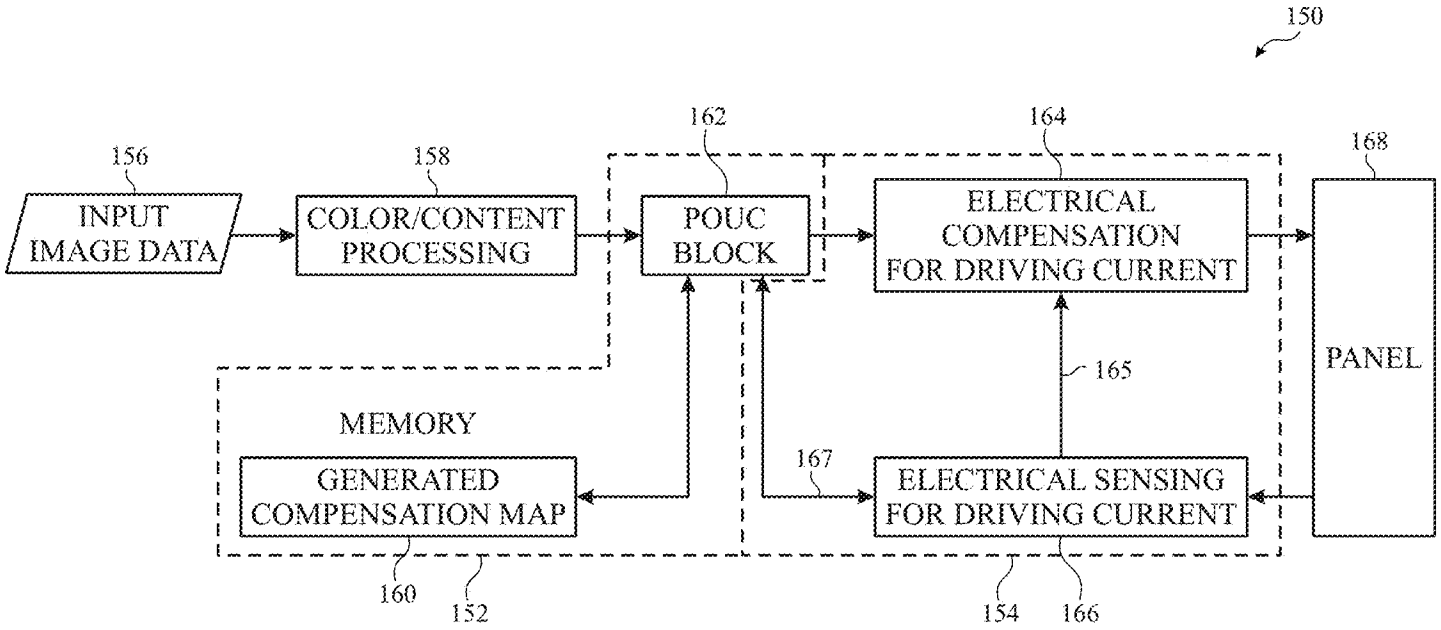
FIG. 10 illustrates a block diagram of circuitry that includes a panel optical uniformity compensation (POUC) block, in accordance with an embodiment.

Since the light emission variations due to curvature of the surface layer 120, aperture variations, and/or other artifacts may be undetectable via internal sensing, other sensing (e.g., external sensing) may be performed to detect such light emission variations. The other sensing (e.g., external sensing) may provide information that may enable the compensation circuitry 26, the sensing circuitry 13, or other suitable component to compensate for the various features (e.g., curvature) of the display 12 that may result in non-uniform properties of the display 12. For instance, FIG. 10 illustrates an embodiment of a block diagram of circuitry 150 that includes first compensation portion 152 (e.g., compensation circuitry 26) and a second compensation portion 154 (e.g., sensing circuitry 13). For example, the first compensation portion 152 may be used to implement compensation based at least in part on externally sensed variations, and the second compensation portion 154 may be used to implement looping compensation based on internally sensed variations. Furthermore, in some embodiments, the internal sensing may be iterated through a loop repeatedly compensating for such internally sensed variations.

The circuitry 150 receives input image data 156 that is then processed using color/content processing circuitry 158 that processes the input image data 156 for color and content. For example, the color/content processing circuitry 158 may set various parameters (e.g., tint, contrast, etc.) of image data for each image frame using one or more settings (e.g., user settings). The processed image data is then compensated using the first compensation portion 152 and the second compensation portion 154. As illustrated, the first compensation portion 152 may include a generated compensation map 160. The generated compensation map 160 may be stored in the storage device(s) 22, or any other suitable medium. The generated compensation map 160 may be loaded from the storage device(s) 22 when the display 12 and/or the electronic device 10 are powered on. The generated compensation map 160 may be generated using one or more externally captured emission maps that captures deviations from expected outputs and may be used by panel optical uniformity compensation (POUC) block circuitry 162 to compensate for the captured deviations. The POUC block circuitry 162 may be implemented using dedicated hardware, instructions executed by the processor(s)/processor core complex 12 and/or other data processing circuitry, or a combination thereof. For example, the generated compensation map 160 may compensate for image data variations for a variety of different temperatures for the display 12.

The POUC block circuitry 162 may be located in a display pipeline to apply compensation to each image frame to be displayed on the display 12. The POUC block circuitry 162 then passes externally compensated image data 163 to the second compensation portion 154. Specifically, the externally compensated image data 163 is passed to electrical compensation circuitry for driving current 164 to perform compensation of a driving current using internally sensed values 165 from electrical sensing circuitry for driving current 166 that senses the internally sensed values 165 from a panel 168. The electrical sensing circuitry for driving current 166 and the POUC block circuitry 162 may both utilize one or more parameters 167, and therefore, may share such parameters. For example, the one or more parameters 167 may include temperature and/or other parameters that may be used to determine compensation values in both the first compensation portion 152 and the second compensation portion 154. Additionally or alternatively, the one or more parameters 167 may be generated by the POUC block circuitry 162 or the electrical sensing circuitry for driving current 166 and used by the other.

Figure 11:
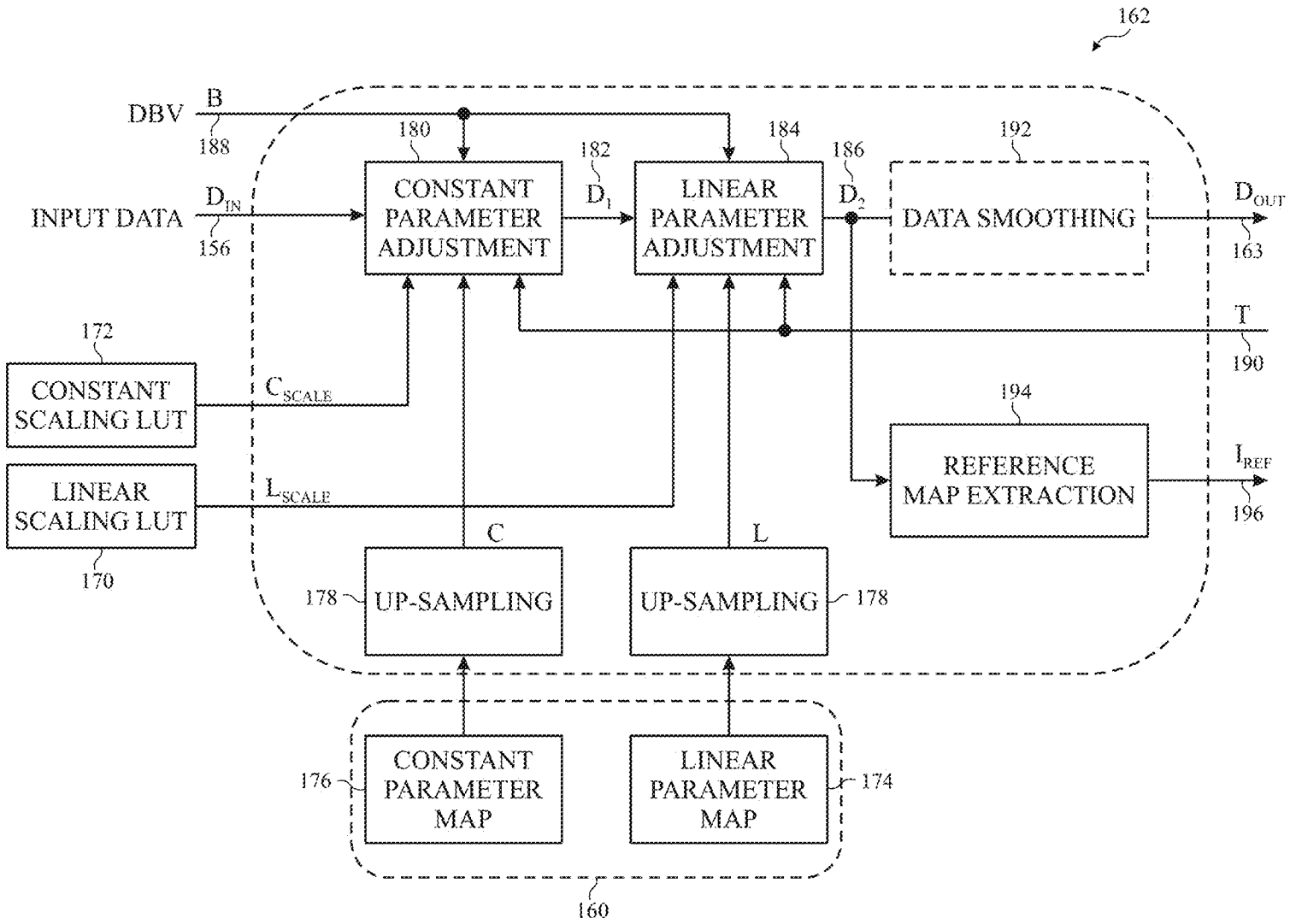
FIG. 11 illustrates a block diagram view of the POUC block of FIG. 10, in accordance with an embodiment.

FIG. 11 illustrates a block diagram of an embodiment of the POUC block circuitry 162. In some embodiments, the POUC block circuitry 162 may be implemented in the processor(s)/processor core complex 12, compensation circuitry 26, or the like. For example, the POUC block circuitry 162 may be implemented in a CPU, a GPU, and/or a display controller for the display 12. The POUC block circuitry 162 may include a linear scaling lookup table (LUT) 170 and a constant scaling LUT 172 that may be used to adjust optical compensation information according to brightness settings and image contents. The linear scaling LUT 170 may be applied as a gain while the constant scaling LUT 172 may be applied as an offset. Similarly, data from the generated compensation map 160 may be bifurcated into a linear parameter map 174 and a constant parameter map 176. In some embodiments, to save storage space and/or processing, the linear parameter map 174 and/or the constant parameter map 176 may not store information for each individual pixel in the display 12 as map(s) of lower resolution of which the display 12 is capable. Instead, the POUC block circuitry 162 may utilize up-samplers 178 to upconvert the data from the linear parameter map 174 and/or the constant parameter map 176.

The values from the constant scaling LUT 172 and the constant parameter map 176 are passed to constant parameter adjustment circuitry 180 to apply offset factors from the constant scaling LUT 172 and the constant parameter map 176 to the input image data 156 to form offset input data 182. Similarly, the values from the linear scaling LUT 170 and the linear parameter map 174 are passed to linear parameter adjustment circuitry 184 that applies the gain factors from the linear scaling LUT 170 and the linear parameter map 174 to the offset input data 182 to generate gained input data 186. A global brightness setting (DBV) 188 and a temperature 190 may be used by constant parameter adjustment circuitry 180 and the linear parameter adjustment circuitry 184 to generate the offset input data 182 and the gained input data 186. In other words, the offset input data 182 may be based at least in part on the input image data 156, the constant scaling LUT 172, the constant parameter map 176, the DBV 188, and the temperature 190.

In some embodiments, low-resolution maps upconverted using up-samplers 178 may cause some artifacts. Accordingly, the POUC block circuitry 162 may include data smoothing 192 that smooths the gained input data 186 to reduce/remove such artifacts from the externally compensated image data 163. For example, the smoothing may include dithering, interpolation, and/or filtering to smooth between regions of the low-resolution maps.

The POUC block circuitry 162 may also include reference map extraction circuitry 194 that generates a reference current 196 that is passed (e.g., as the one or more parameters 167) to the electrical sensing circuitry for driving current 166. The reference current 196 is used by the electrical sensing circuitry for driving current 166 as a baseline to start with rather than assuming an ideal current. In other words, the reference current 196 enables the electrical sensing circuitry for driving current 166 to quickly refine the driving current properly.

Figure 12:
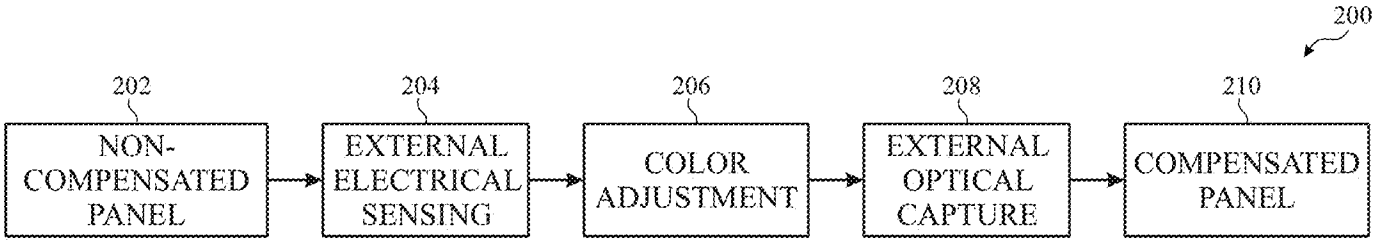
FIG. 12 illustrates a flow diagram view of a calibration process for the display of FIG. 1, in accordance with an embodiment.

FIG. 12 illustrates a flow diagram 200 of a calibration process that may be performed during or after manufacture of the display 12 in accordance with the embodiments described herein. A non-compensated panel 202 is submitted to external electrical sensing that electrically senses values in the non-compensated panel 202 (block 204). The panel then undergoes color adjustment based on the external electrical sensing (block 206). Then, an appearance of the display 12 is externally and optically captured for use by the POUC block circuitry 162 (block 208). This optical capture is used to generate the generated compensation map 160 that is used by the POUC block circuitry 162. In some embodiments, the optical capture may be captured at multiple temperatures. Furthermore, in certain embodiments, each panel may be individually tested. Additionally or alternatively, a panel may be used to represent multiple panels as a representative sample. Thus, a single panel may be used to represent a batch of panels.

Figure 13:
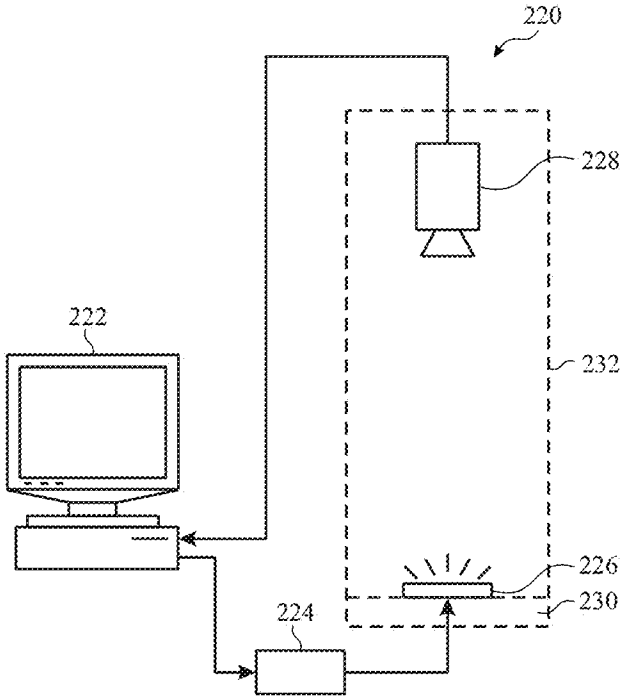
FIG. 13 illustrates a block diagram view of a calibration system used to obtain compensation values for the display of FIG. 1, in accordance with an embodiment.

FIG. 13 illustrates a block diagram of a capture system 220. The capture system 220 includes a computing device 222 that utilizes a display controller 224 to control a panel 226 under testing. For instance, the computing device 222 may instruct the display controller 224 to cause the panel 226 to display a calibration image that is captured by an image sensor 228. For example, the image sensor 228 may include a high-resolution imaging capture device, such as a camera or a photometer. In some embodiments, the panel 226 may be tested under multiple temperatures using a temperature control 230. For instance, the temperature control 230 may include heating elements that change a temperature of the panel 226 under testing. Furthermore, in some embodiments, the image sensor 228 and the panel 226 may have a fixed relative position in a capture fixture 232 that enables rapid successive testing of multiple panels 226.

Figure 14:
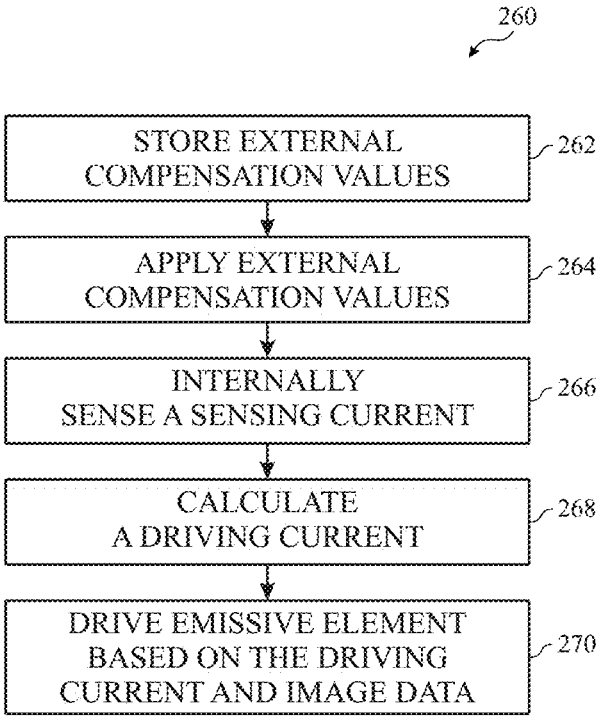
FIG. 14 illustrates a flow diagram of a process for compensating driving of a display to account for variations in the display, in accordance with an embodiment.

FIG. 14 is a flow diagram of a process 260 for adjusting certain parameters (e.g., driving current) of various pixels 100 to present image data with more uniform properties across the display 12. The process 260 may include storing external compensation values in a generated compensation map 160 for the display 12 (block 262). The external compensation values compensate for variations from expected values captured from outside of the electronic device 10. The generated compensation map 160 may be stored in the storage device(s) 22 or other suitable medium. The generated compensation map 160 may include multiple sub-maps. For example, each sub-map may correspond to various values of a parameter (e.g., temperature, global brightness setting, etc.). The generated compensation map 160 may be used to compensate for artifacts that are not detectable using internal sensing. For example, the artifacts may be attributed to curvature of a screen of the display 12, fine metal mask misalignment, and/or other factors.

The processor(s)/processor core complex 12 then applies the external compensation values using the POUC block circuitry 162 to compensate for the externally captured variations (block 264). The POUC block circuitry 162 may include dedicated circuitry and/or the processor(s)/processor core complex 12 implementing specific software instructions from the storage device(s) 22 or other suitable medium. After applying the external compensation values, the processor(s)/processor core complex 12 internally senses a sensing current of the emissive element 102 (block 266). Based at least in part on the sensing current, the processor(s)/processor core complex 12 calculates a driving current compensation for the emissive element 102 (block 268). The sensing current may be indicative of aging of the display 12, and the calculated driving current may compensation for aging of the display 12. The processor(s)/processor core complex 12 then cause the emissive element 102 to be driven based at least in part on image data and the driving current (block 270).

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure. Furthermore, it should be further understood that each of the embodiments disclosed above may be used with any and all of the other embodiments disclosed herein. The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. A method comprising:

retrieving one or more external compensation values from a compensation map for a display of an electronic device, wherein the one or more external compensation values are configured to compensate for one or more variations from one or more expected values associated with the display, wherein the one or more external compensation values are based on image data captured from outside of the electronic device, wherein the one or more external compensation values are configured to correct one or more non-uniform properties of the display comprising a curvature of a screen of the display at manufacture of the display;

applying the one or more external compensation values to input image data, thereby compensating the input image data for the one or more variations;

internally sensing a sensing current of an emissive element of the display internal to the electronic device based at least in part on the input image data after applying the one or more external compensation values to the input image data;

calculating a driving current compensation for the emissive element based at least in part on the sensing current and the one or more external compensation values; and driving the emissive element based at least in part the driving current compensation.

2. The method of claim 1, wherein the one or more non-uniform properties of the display comprise a fine metal mask misalignment during manufacture of the display.

3. The method of claim 1, wherein internally sensing the sensing current is configured to offset one or more effects of aging on the emissive element.

4. The method of claim 3, wherein the emissive element comprises a self-emissive element.

5. The method of claim 1, wherein the compensation map is configured to compensate for the one or more variations at multiple temperatures.

6. The method of claim 1, wherein the one or more variations are captured using an image sensor.

7. The method of claim 6, wherein the image sensor comprises a camera or a photometer.

8. The method of claim 1, wherein the compensation map comprises a lower resolution than a resolution of the display.

9. Non-transitory, computer-readable, and tangible medium storing instructions thereon, that when executed, are configured to cause one or more processors to:

retrieve one or more external compensation values from one or more generated compensation maps for a display of an electronic device storing the instructions, wherein the one or more external compensation values compensate for one or more variations from one or more expected values associated with the display, wherein the one or more external compensation values are determined based on image data captured from outside of the electronic device, wherein each of the one or more generated compensation maps comprises a lower resolution than a display resolution of the display, wherein the one or more external compensation values are configured to correct one or more non-uniform properties of the display comprising a fine metal mask misalignment during manufacture of the display;

apply the one or more external compensation values to input image data to compensate for the one or more variations;

after applying the one or more external compensation values to the input image data, internally sense a sensed parameter of an emissive element of the display internal to the electronic device; and causing the emissive element to be driven based at least in part on a sensed parameter compensation that is based at least in part on the sensed parameter.

10. The non-transitory, computer-readable, and tangible medium of claim 9, wherein the instructions are configured to receive one or more linear scaling values and one or more constant scaling values that scale the input image data based at least in part on a brightness setting or gray level of the input image data.

11. The non-transitory, computer-readable, and tangible medium of claim 9, wherein the one or more generated compensation maps are divided into a linear parameter lookup table configured to store one or more gain factors to be applied based at least in part on the one or more variations and a constant parameter lookup table configured to store one or more offset values to be applied based at least in part on the one or more variations.

12. The non-transitory, computer-readable, and tangible medium of claim 9, wherein the instructions are configured to cause the one or more processors to up-sample the one or more generated compensation maps.

13. The non-transitory, computer-readable, and tangible medium of claim 12, wherein the instructions are configured to cause the one or more processors to smooth the one or more externally compensated values due to a resolution mismatch of the input image data and the one or more generated compensation maps.

14. The non-transitory, computer-readable, and tangible medium of claim 9, wherein the instructions are configured to cause the one or more processors to generate an indication of a reference parameter used in deriving the sensed parameter compensation.

15. The non-transitory, computer-readable, and tangible medium of claim 9, wherein the one or more non-uniform properties of the display comprises a curvature of the display at manufacture.

16. A system, comprising:

a display having sensing circuitry configured to sense one or more parameters of the display during an off state of the display;

panel optical uniformity compensation (POUC) block circuitry comprising:

a constant parameter adjustment configured to output offset image data based at least in part on received image data and a constant parameter map indicating an offset to be applied to the image data to be displayed on the display to at least partially offset a variation of an appearance of the display that is not internally sensed in the display, wherein the variation of the appearance of the display is based at least in part on a curvature of the display at manufacture or a fine metal mask misalignment during manufacture; and a linear parameter adjustment configured to output externally compensated image data based at least in part on the offset image data and a linear parameter map, wherein the linear parameter map indicates a scaling factor to be applied to image data to be displayed on the display to at least partially offset the variation; and a sensing loop configured to sense aging of the display from within the display using a sensing current and to apply aging compensation to the externally compensated image data.

17. The system of claim 16, comprising a processor, wherein the POUC block circuitry comprises instructions executed in the processor.

18. The system of claim 16, wherein the linear parameter map and the constant parameter map are generated based at least in part on one or more optical variations captured during manufacture of the display.

19. The system of claim 16, wherein the linear parameter map and the constant parameter map are generated for the display using another display representative of the display.

20. The system of claim 16, wherein the linear parameter adjustment and the constant parameter adjustment are based at least in part on at least one of a global brightness value and a temperature.

* * * * *